US007150355B2

(12) United States Patent
Coe et al.

(10) Patent No.: US 7,150,355 B2
(45) Date of Patent: Dec. 19, 2006

(54) CASE WITH PILL RECEIVING SLEEVES FOR STORING AND DISPENSING PILLS

(75) Inventors: Matthew T. Coe, Annandale, NJ (US); Kun-Chi Wu, Princeton, NJ (US)

(73) Assignee: PharmaDesign Inc., Warren, NJ (US)

( * ) Notice: Subject to any disclaimer, the term of this patent is extended or adjusted under 35 U.S.C. 154(b) by 0 days.

(21) Appl. No.: 10/932,455

(22) Filed: Sep. 2, 2004

(65) Prior Publication Data

US 2005/0051454 A1 Mar. 10, 2005

Related U.S. Application Data

(60) Provisional application No. 60/500,207, filed on Sep. 4, 2003.

(51) Int. Cl.
*B65D 83/04* (2006.01)

(52) U.S. Cl. ..... 206/536; 206/531; 206/532; 206/538

(58) Field of Classification Search ..... 206/531, 206/532, 535, 536, 538, 747, 748, 749, 472, 206/473
See application file for complete search history.

(56) References Cited

U.S. PATENT DOCUMENTS

| | | | | |
|---|---|---|---|---|
| D138,698 | S * | 9/1944 | Salfisberg | D9/700 |
| 3,414,119 | A | 12/1968 | Finch, Jr. | |
| 4,848,585 | A | 7/1989 | Snyder | |
| 5,105,949 | A * | 4/1992 | Blair | 206/534 |
| D339,742 | S | 9/1993 | Walchek, Jr. et al. | |
| D340,860 | S | 11/1993 | Gordon et al. | |
| 5,348,158 | A | 9/1994 | Honan et al. | |
| 5,351,818 | A * | 10/1994 | Daneshvar | 206/216 |
| 5,368,187 | A | 11/1994 | Poncetta et al. | |
| 5,372,258 | A | 12/1994 | Daneshvar | |
| D358,546 | S | 5/1995 | Walchek, Jr. et al. | |
| D358,762 | S | 5/1995 | Walchek, Jr. et al. | |
| D411,445 | S | 6/1999 | Anderson | |
| D414,106 | S | 9/1999 | Anderson | |
| 5,954,203 | A | 9/1999 | Marconi | |
| 6,036,018 | A | 3/2000 | Harrold | |
| D423,111 | S | 4/2000 | Davis et al. | |
| D430,392 | S | 9/2000 | Noble | |
| 6,173,838 | B1 * | 1/2001 | Brozell | 206/538 |
| 6,199,689 | B1 | 3/2001 | Higuchi et al. | |
| 6,219,997 | B1 | 4/2001 | Friberg et al. | |
| 6,338,408 | B1 | 1/2002 | Anderson | |
| D460,254 | S | 7/2002 | Rufo | |
| 6,550,618 | B1 * | 4/2003 | Peterson | 206/534 |
| 6,789,677 | B1 * | 9/2004 | Maietta | 206/536 |
| D508,164 | S | 8/2005 | Coe et al. | |
| 2003/0106814 | A1 | 6/2003 | Gelardi et al. | |

* cited by examiner

*Primary Examiner*—David T. Fidei
(74) *Attorney, Agent, or Firm*—Sterne, Kessler, Goldstein & Fox P.L.L.C.

(57) ABSTRACT

A case for receiving and dispensing pills, having an optional top cover having a forward edge and a rearward edge, an optional bottom cover having a forward edge and a rearward edge, a spine extending between the top cover and the bottom cover, to which the top cover and the bottom cover are affixed at the rearward edges thereof, and at least one sleeve containing a plurality of pills secured within the sleeve and adapted to be dispensed therefrom, the sleeve having a forward edge and a rearward edge and being attached to the spine at the rearward edge thereof between the top cover and the bottom cover.

39 Claims, 12 Drawing Sheets

CASE WITH PILL RECEIVING SLEEVES FOR STORING AND DISPENSING PILLS

RELATED APPLICATION

This Application claims the priority benefit of U.S. Provisional Patent Application Ser. No. 60/500,207 filed Sep. 4, 2003.

FIELD OF THE INVENTION

The present invention is relates to a case, and more particularly a case having at least one article receiving sleeve which may be removably or permanently secured within the case. The sleeve is used to store and dispense the article such as a pill.

BACKGROUND OF THE INVENTION

Pill cases are known in the art and typically contain a plurality of pills which can be accessed by the user as needed. Pill cases known in the art are desirably compact so that they can be carried by the user in a purse or in a shirt pocket or other convenient location.

Some users are required to take medication for extended periods of time. Examples of such medications include medicines for treating chronic illnesses such as elevated blood pressure, cardiac deficiencies, arthritis, illnesses in which pain is part of an on-going treatment plan, and the like. In addition, life-style related medications such as birth control pills, hormone replacement pills and the like also require long term, periodic use.

Pill storage/dispensing devices, especially for long term use medications, typically suffer from a number of disadvantages. One such device is a container typically used by pharmacies to fill prescriptions for medications. These containers are disadvantageous because the pills can be adversely affected (e.g. chipped or broken) by unwanted contact with other pills and can easily fall out of the container when attempting to dispense a typical dose of one or two pills. In addition, such containers do not enable the user to readily visualize how many pills remain in the container. Some pill dispensers are typically limited to a fixed number of pills before they must be replaced and therefore can only be used for relatively short term prescription periods (e.g. no more than 30 days).

Other pill storage/dispensing cases are shown and described in U.S. Design Pat. Nos. Des. 339,742; Des. 358,762; Des. 411,445; Des. 414,106; and Des. 423,111; as well as U.S. Pat. Nos. 3,414,119; 5,348,158; 5,351,818; 5,368,187; 5,372,258; 6,036,018; 6,173,838; and 6,219,997 each of which is incorporated herein by reference.

Some pill dispensing/storage cases now employ blister cards or blister packs which house a preselected number of pills and which protect each pill so that they cannot be broken by contact with other pills. The blister cards store pills in spaced apart pill receiving cavities which are then sealed using a protective cover such as coated paper, foil, plastic or the like. The pills may be removed from the cavities by piercing the cover or by applying pressure to one side of the covered pill until the pill bursts through the protective cover. More detailed descriptions of blister cards or packs are disclosed, for example, in U.S. Pat. Nos. 5,368,187; 6,036,018; 6,219,997; and 6,338,408, each of which is incorporated herein by reference. Despite these efforts there remains the need for a pill storage/dispensing device that a) is compact, b) easily opened to gain access to the pills, c) capable of accommodating pills for extensive prescription periods, d) capable of accommodating sleeves for receiving different pills and/or dosage regimens and e) wherein the sleeves can accommodate multiple blister cards or packs, which are either permanently or removably secured to the pill case.

It would therefore be a significant advantage in the art to provide users an opportunity to house medications in a pill storing/dispensing device which can readily house individual pills in separate compartments and which facilitates dispensing of the desired dose of pills. It would also be an advantage in the art if the pill containing device can house a varying quantity of pills depending on the particular requirements of the medication and the dosage regimen required by the user which may be in the form of blister cards which have varying numbers of pills such as may be used for dispensing oral contraceptive medications.

It would be a further advantage in the art to provide a pill storage/dispensing device having multiple sleeves, where each sleeve receives and dispenses a number of pills corresponding to a particular dosage regimen. It would be a further advantage in the art if the device can accommodate relative long term prescriptions (e.g. more than 30 days) and it would be a still further advantage in the art if the pill case can be in a compact form, easy to carry and store in a purse, shirt pocket or the like.

SUMMARY OF THE INVENTION

The present invention is generally directed to a case which provides for at least one pill receiving sleeve which may be removably or permanently secured to a spine. Each sleeve may be independently replaced by removing the same from the spine when the pills received therein have been dispensed or the entire case may be discarded when all of the pills in the sleeves have been consumed. The case provides for multiple pill receiving sleeves which may optionally be secured to each other or to a top or bottom cover to enable access to an individual pill receiving sleeve as desired.

Each pill receiving sleeve may be adapted to receive a plurality of pills which may be matched with a particular dosage regimen particularly suited for the user. For example, if the user requires two pills a day, then one or more sleeves may contain 14 pills (covering one week) or 60 pills (covering one month). The use of multiple sleeves can therefore accommodate long term prescriptions. The pills can be secured to the sleeves in a variety of ways including the use of blister cards or packs. When using a blister card, the pills are individually stored in blister cards or packs which fit within the sleeve and may be readily removed therefrom.

Alternatively, the sleeves per se may be provided with the pills of the dosage regimen (i.e. the pills are not packaged in a blister card). The sleeves may be easily removed from the case when all of the pills of one sleeve have been consumed and replaced by another sleeve which may contain the same or different medication accordingly to need or the case may be discarded after all of the pills have been consumed.

It will be understood that reference to the term "pill" as used herein shall include not only pills of a variety of shapes and sizes but all forms of dispensable products or articles of manufacture such as medications which can effectively be housed in the device of the present invention including tablets, capsules, lozenges, caplets and the like. Likewise, all reference to a "pill case" shall mean a case which can accommodate the dispensable product or article of manufacture. The term "pill receiving sleeve" shall mean a sleeve or tray which can receive a blister card or blister pack containing prepackaged pills or which can itself contain pills which may be dispensed therefrom without the use of a blister card.

The case may optionally have a top cover and a bottom cover which are used to protect the sleeves and may be readily separated from the sleeves to gain access to the sleeves and the pills received therein. The top and bottom covers are reversibly engageable so that the top and bottom covers may be moved from a closed position to an open position, exposing the pill receiving sleeves. In an optional feature of the present invention, the sleeves may reversibly engage the top and/or bottom covers in a manner such that when the top and bottom covers are moved to an open position, only one pill receiving sleeve may be exposed.

In one aspect of the present invention, there is provided a case, comprising a spine and at least one, more typically a plurality of sleeves, with each of the sleeves being configured to receive and dispense at least one article of manufacture (e.g., pills) therefrom such as, for example, via a blister card containing a plurality of pills.

In a further aspect of the invention there is provided a case for receiving and dispensing pills, comprising:

at least one sleeve containing a plurality of pills secured within the sleeve and adapted to be dispensed therefrom, the sleeve having a rearward edge for engaging a spine; and the spine comprising a sleeve engaging locking assembly operatively engaging the at least one sleeve at the rearward edge so that the sleeves are secured to the spine and can be accessed to dispense the pills contained therein.

In another aspect of the present invention, there is provided a case in which top and bottom covers are provided to give protection to the sleeves, the case comprising:

a top cover having a forward edge and a rearward edge;

a bottom cover having a forward edge and a rearward edge;

a spine extending between the top cover and the bottom cover, to which the top cover and the bottom cover are affixed at the rearward edges thereof; and at least one sleeve containing a plurality of pills secured within the sleeve and adapted to be dispensed therefrom, the sleeve having a forward edge and a rearward edge and being attached to the spine at the rearward edge thereof between the top cover and the bottom cover.

In a further aspect of the present invention the above sleeves are adapted for receiving and retaining a blister card containing a plurality of pills in which the pills are dispensed from the blister card contained in the sleeve.

In a still further aspect of the present invention, there is provided a case, comprising:

a) at least one pill receiving sleeve comprising a pill storage portion for storing a plurality of pills therein and a sleeve engaging locking assembly engaging portion;

b) a top cover and a bottom cover each having a first side for operatively engaging a sleeve engaging locking assembly and an opposed side, the top and bottom covers being movable toward each other to place the case in a closed position wherein the pills within the pill receiving sleeves are not exposed, and away from each other to an open position wherein at least one of the pill receiving sleeves and pills received therein are exposed; and c) the sleeve engaging locking assembly operatively engaged to the first side of each of the top cover and the bottom cover and comprising at least one sleeve engaging connector for engaging the sleeve engaging locking assembly engaging portion of the pill receiving sleeve in a side loading motion.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a case (e.g., pill case) with at least one article receiving sleeve (e.g., pill receiving sleeve) secured therein by a sleeve engaging locking assembly in which the sleeves are operatively engaged to the sleeve engaging locking assembly.

It will be understood that the present invention can be used to store and dispense a variety of articles such as gum, confections, and the like. For illustrative purposes, reference hereinafter will be to a pill case for dispensing pills. As will be explained hereinafter, the pill receiving sleeves may be permanently affixed to the pill case or replaceable as desired. The pill receiving sleeves may be easily engaged and optionally disengaged from the sleeve engaging locking assembly to enable users, even those suffering from the loss of manual dexterity, to easily remove pills from the pill receiving sleeve and optionally replace pill receiving sleeves with a new full set of pills contained therein as needed. The pills may be individually stored in blister cards or packs, which fits within the sleeve and may be readily dispensed therefrom.

Figure 1:
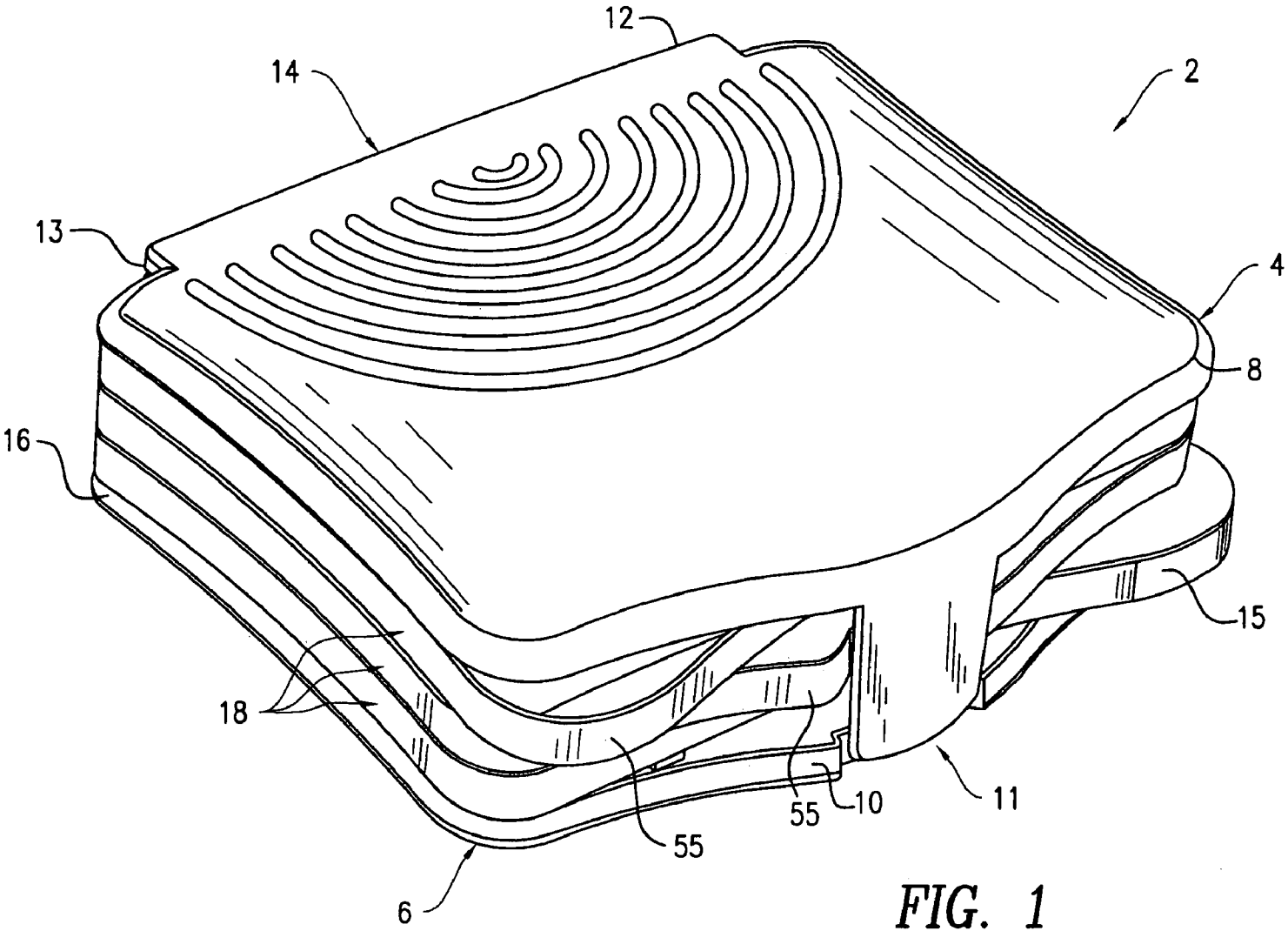
FIG. 1 is a perspective view of an embodiment of a pill case of the present invention in the closed position with none of the pill receiving sleeves exposed.

Referring to the drawings and first to FIG. 1, there is shown a pill case 2 in accordance with an embodiment of the present invention having an optional top cover 4 and an optional bottom cover 6 spaced apart from each other by a spine 13 including a sleeve engaging locking assembly 14 which optionally enables pill receiving sleeves or trays 18 to be replaced as needed. The top cover 4 has a forward end 8 and the bottom cover 6 has a corresponding forward end 10, each of which may operatively engage adjacent pill receiving sleeves 18 to secure the pill case 2 in the closed position via a clasp mechanism 11 as specifically shown in FIG. 1 and as explained in detail hereinafter.

The top cover 4 has a rearward end 12, which is operatively engaged to the sleeve engaging locking assembly 14 forming part of the spine 13 through a living hinge or other appropriate attachment device as described hereinafter. The bottom cover 6 has corresponding rearward end 16, which is likewise operatively engaged to the sleeve engaging locking assembly 14 of the spine 13 in a manner similar to the top cover 4.

The pill case 2 shown in FIG. 1 contains at least one, preferably a plurality of pill receiving sleeves 18 which are removably engaged to the sleeve engaging locking assembly 14 positioned on the spine 13 of the pill case 2. In the embodiment shown in FIG. 1, the pill receiving sleeves 18 are in a stacked arrangement with the sleeves 18 positioned one on top of another.

Figure 2:
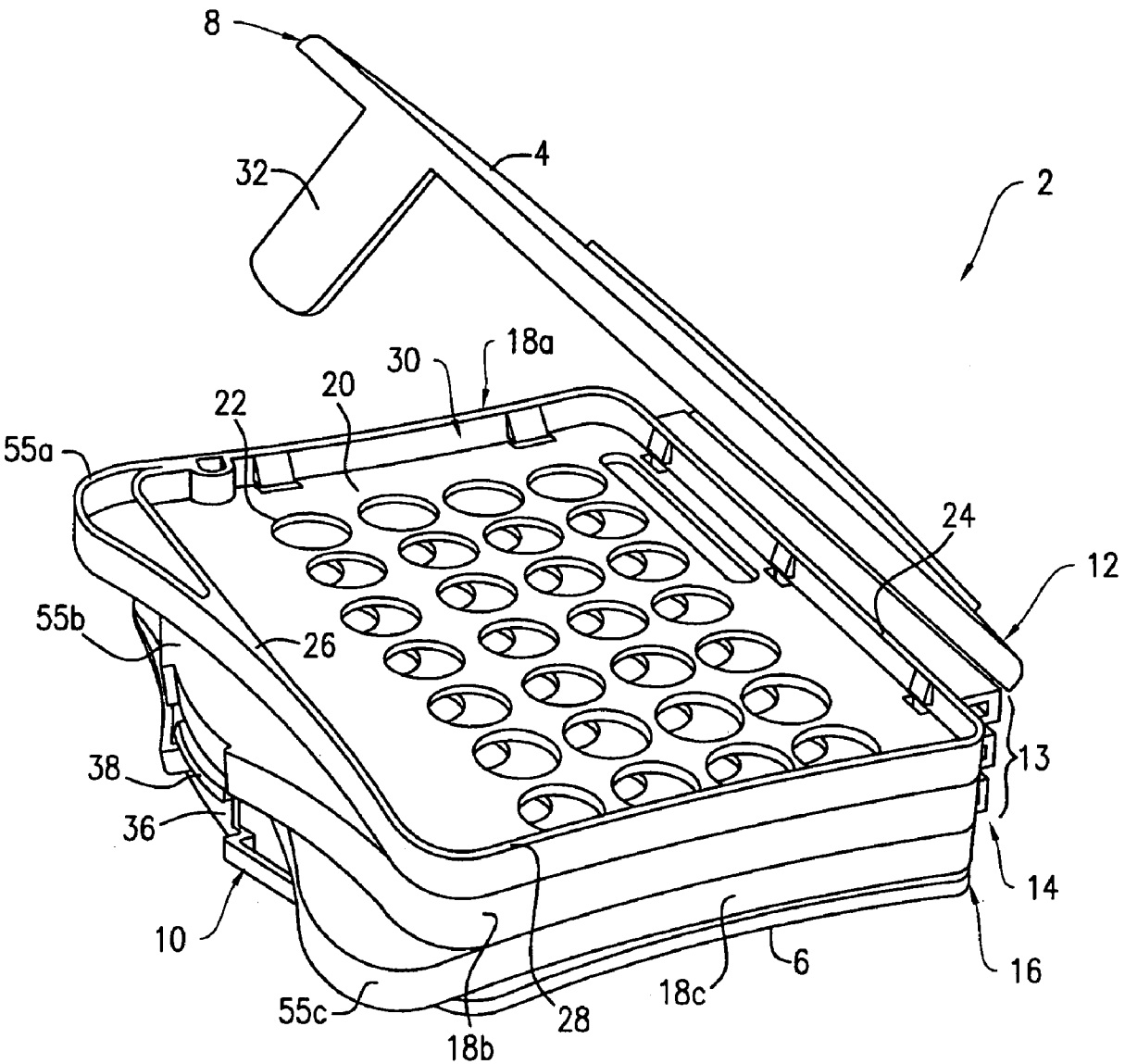
FIG. 2 is a perspective view of the embodiment of the pill case shown in FIG. 1 in an opened position exposing one of the pill receiving sleeves contained therein.
Figure 3:
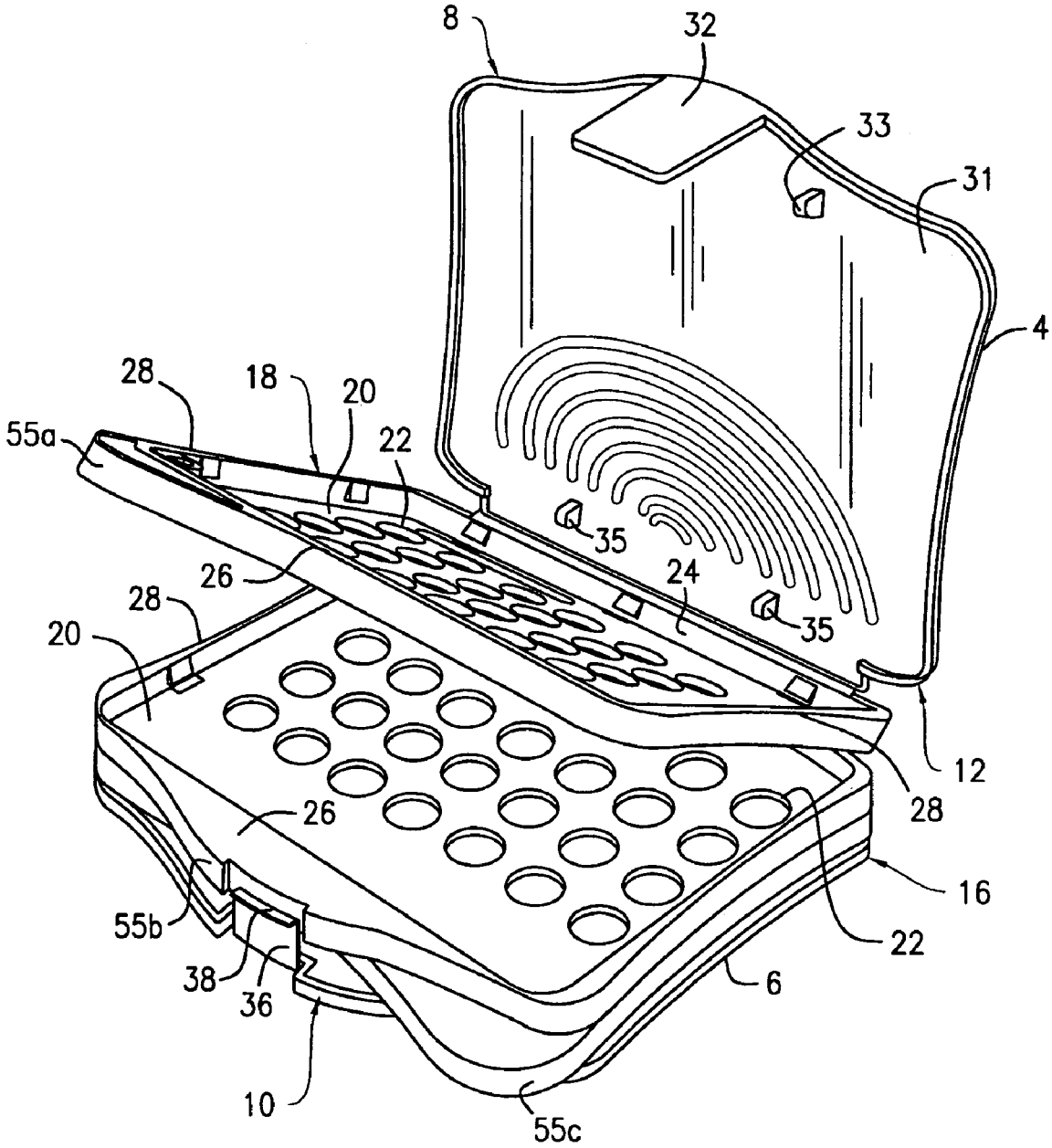
FIG. 3 is a perspective view of the embodiment of the pill case shown in FIG. 1 in an opened position exposing some of the pill receiving sleeves contained therein.
Figure 4:
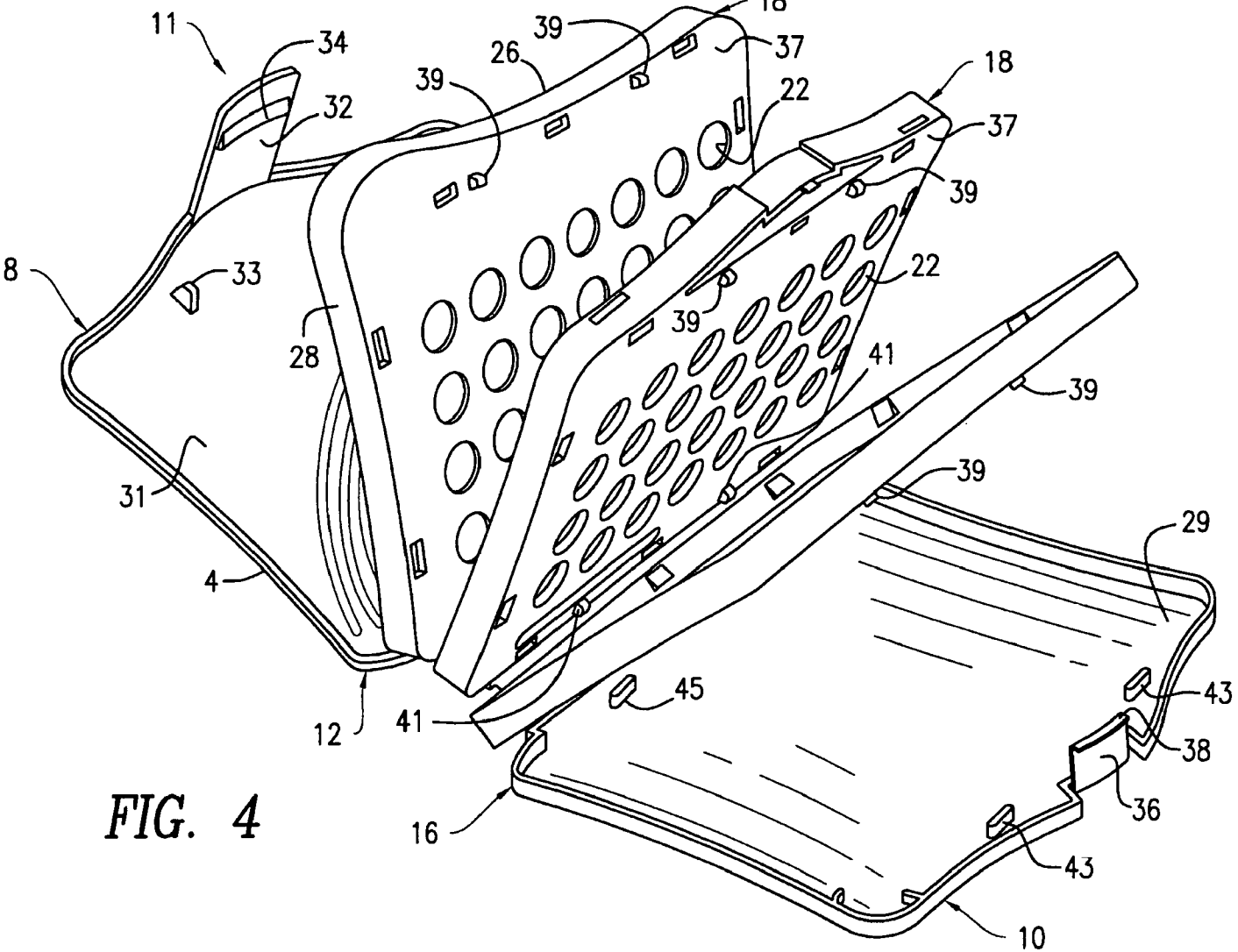
FIG. 4 is a perspective view of the embodiment of the invention shown in FIG. 1 in which the pill case is in a fully opened position exposing all of the pill receiving sleeves contained therein.

Referring to FIGS. 2, 3 and 4, each of the pill receiving sleeves 18 comprises a base 20 having a plurality of apertures 22. Each aperture 22 is sized to correspond to the size of a pill contained within a blister card so that the pill may be released from the blister card through the aperture 22 as desired. Alternatively, each aperture 22 may contain therein a pill (not shown) protected by a cover, which can be released from the base by exerting pressure on the pill to break the protective cover. In the alternative embodiment, each pill has in effect its own individual compartment. In both embodiments each pill is not adversely affected by contact with other pills. The size and shape of the apertures may be selected to suit the size and shape of the particular type of pill.

Each of the sleeves 18 has a rearward wall 24 (see FIG. 2) which is adapted to engage the sleeve engaging locking assembly 14 as hereinafter described. The pill receiving sleeve 18 also has an opposed wall 26 and sidewalls 28 which together with the base 20 and the rearward wall 24 form a pill containing area 30 for housing the blister card and which helps to prevent a blister card from sliding out of the pill receiving sleeve 18.

The pill case 2 may be further provided with an optional system for aligning and securing respective adjacent pill receiving sleeves 18 with the top and/or bottom covers. This optional system enables a single pill receiving sleeve 18 in a multiple sleeve embodiment to be exposed for dispensing a pill, while allowing the remaining pill receiving sleeves 18 and/or top and bottom covers 4, 6 to remain closed.

More specifically, as shown best in FIG. 3, the top cover 4 has an underside surface 31 having two pair of spaced apart detents 33 and 35 extending therefrom. Each pair of detents 33 and 35 extends from the underside surface 31 of the top cover 4 for frictionally engaging opposed wall 26 and the rearward wall 24, respectively, of the adjacent pill receiving sleeve 18 to align the adjacent pill receiving sleeve 18 with the top cover 4 to as shown in FIG. 1.

In particular, the pair of detents 35 frictionally engage the rearward wall 24 while the pair of detents 33 frictionally engage the opposed wall 26 of the pill receiving sleeve 18 when the top cover 4 is closed over the adjacent pill receiving sleeve 18 shown in FIG. 3. Because the pairs of detents 33, 35 are only frictionally engaged to the respective walls 24,26 of the pill receiving sleeve 18, the top cover 4 may be easily moved into a position in which the top cover 4 is secured to the adjacent pill receiving sleeve 18 and then released therefrom to expose the adjacent pill receiving sleeve 18 and the pills contained therein.

The pill case 2 is securable in the closed position to form a compact pill case using a clasp mechanism 11 as shown in FIG. 1. The clasp mechanism 11 includes an elongated projection 32 having on an inner surface a transversely extending detent 34 (as best shown in FIG. 4). The projection 32 extends downwardly from the forward end 8 of the top cover 4 to the forward end 10 of the bottom cover 6 as shown in FIG. 1.

Figure 10:
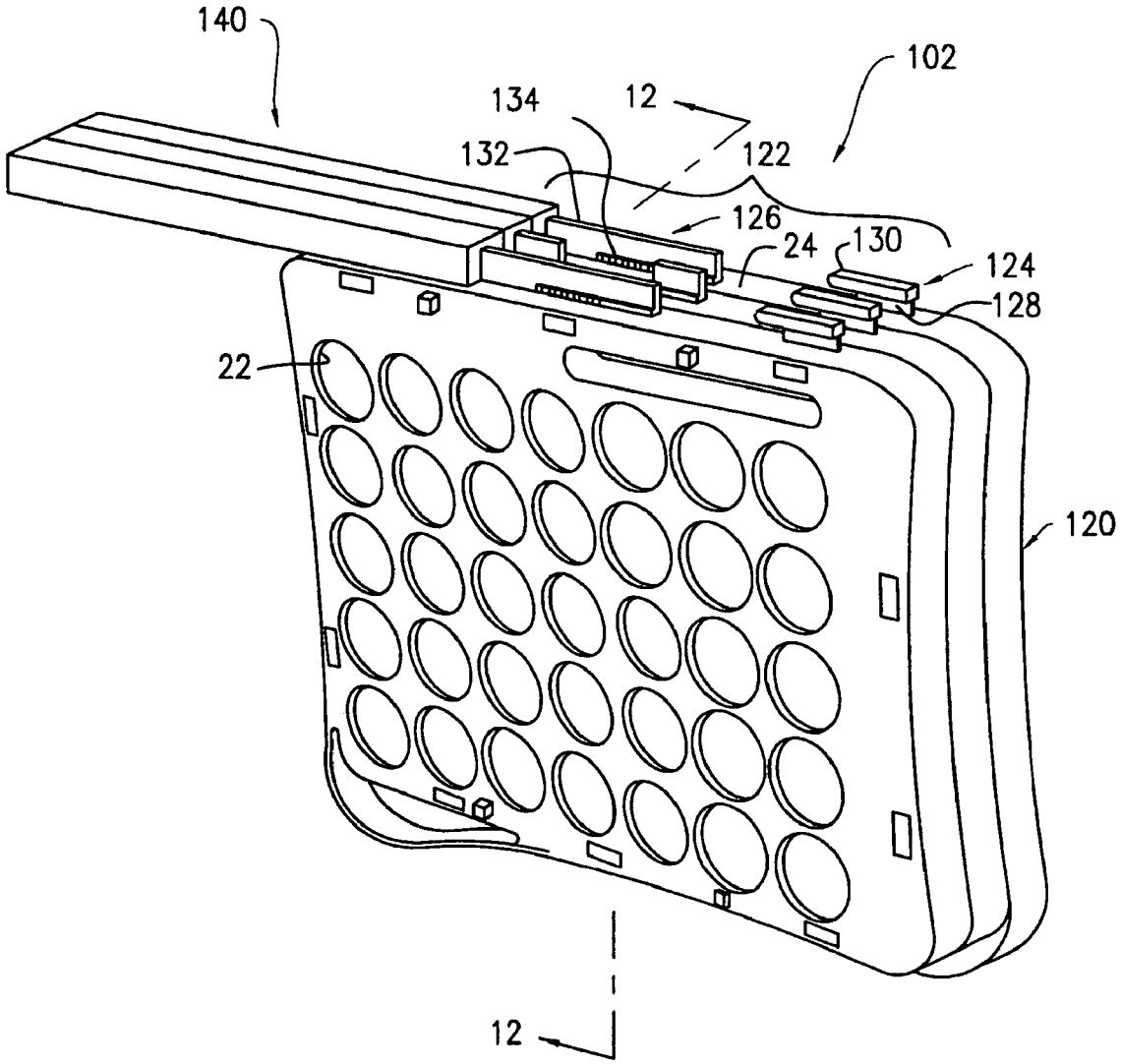
FIG. 10 is a partial perspective view of an alternate embodiment of a sleeve engaging locking assembly of a pill case of the present invention.

There is also provided a projection engaging latch 36 which extends upwardly from the forward end 10 of the bottom cover 6 in a direction that will enable the projection 32 and latch 36 to operatively engage each other in a locking position to thereby secure the pill case in the closed position (See FIG. 1) and disengage from each other by dislodging the projection 32 from the latch 36 to enable the pill case 2 to move to an open position exposing the pill receiving sleeve 18 as shown in FIG. 10.

The latch 36 is provided with a forwardly extending lip 38 which engages the detent 34 to removably secure the pill case in the closed position. It will be understood that other suitable clasp mechanisms (e.g. hook and eye connectors) can be used for the same purpose.

As part of the optional system described above, each of the pill receiving sleeves 18 has an underside surface 37 (See FIG. 4) which also contains respective pairs of detents 39 and 41 which frictionally engage the inside surface of the rearward wall 24 and opposed wall 26 of the next adjacent pill receiving sleeve 18 immediately therebelow as shown best in FIG. 4. It will be noted that each of the pairs of detents 39 and 41 frictionally engage the inside surfaces of the respective walls 24 and 26 to provide a corresponding frictional contact therewith. The employment of the pairs of detents 39 and 41 therefore provides secure alignment of the adjacent pill receiving sleeves 18 with one another. In this manner, if the pill container 2 contains more than two pill receiving sleeves 18, one of sleeves may be exposed to allow access to the pills while the remainder of the sleeves may remain together as shown specifically in FIG. 3. Other means of detachably aligning the pill receiving sleeves 18 together would be apparent to those of ordinary skill in the art.

As previously indicated, the top cover 4 may be secured to the adjacent pill receiving sleeve 18 through the employment of respective pairs of detents 33 and 35 frictionally engaging the rearward wall 24 and opposed wall 26 on the inside surfaces thereof, respectively. The bottom cover 6 may be provided with respective adjacent pairs of detents 43 and 45 (see FIGS. 4 and 6) extending from the underside surface 29 of the bottom cover 6 frictionally engage corresponding detents 39 and 41 extending from the underside surface 37 of the adjacent pill receiving sleeve 18. In this manner, the adjacent pill receiving sleeve 18 is securely aligned with respect to the bottom cover 6.

Thus, the present pill case provides an optional system for aligning an adjacent pill receiving sleeve 18 with the top cover 4, an adjacent pill receiving sleeve 18 with the bottom cover 6 and the alignment of adjacent pill receiving sleeves 18 to each other. This detachable aligning and securing arrangement enables the user to access a single pill receiving sleeve 18 for retrieving a pill therefrom while keeping the other pill receiving sleeves 18 secured together as shown, for example, in FIG. 3. In addition, by pushing the top cover 4 towards the bottom cover 6 so that all of the pill receiving sleeves 18 are aligned together with the top and bottom covers, the pill case will assume the completely closed position shown in FIG. 1 for protecting the pills contained therein.

When the pill case is in the closed position as shown in FIG. 1, access to the pill receiving sleeves 18 may be facilitated by tabs 55 extending from the outside surface of the wall 26 of the sleeves 18. The tabs 55 may be contacted by a finger or a thumb and lifted to thereby raise any sleeve 18 which is located above the particular tab 55 as well as the cover 4, thus exposing the pill receiving sleeve 18 immediately below the particular tab 55.

By way of example and referring to FIG. 2, the pill case 2 includes three pill receiving sleeves 18*a*, 18*b*, and 18*c* each having extending therefrom at the wall 26, respective tabs 55*a*, 55*b*, and 55*c*. If the tab 55*b* and thus sleeve 18*b* is lifted upwardly, the sleeve 18*a* and the cover 4 will likewise be lifted thereby exposing pill receiving sleeve 18*c* and the pills received therein. Thus, the tabs 55 not only facilitate entry to the contents of the pill case 2 in general, but particularly to an individual pill receiving sleeves 18 as desired.

Figure 5:
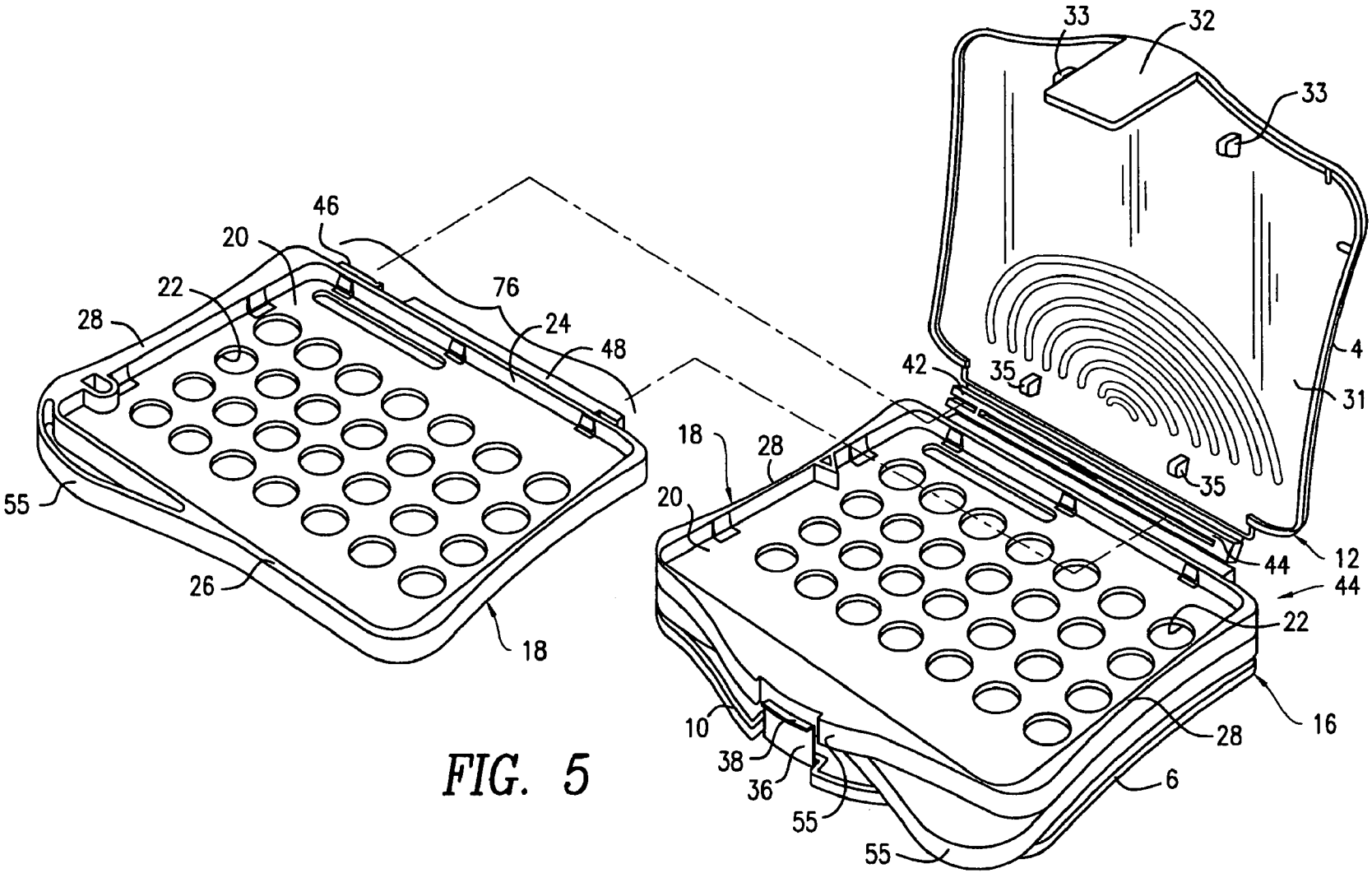
FIG. 5 is a partially exploded view of the embodiment of the pill case shown in FIG. 1 with one of the pill receiving sleeves removed and showing the interaction of the sleeve engaging locking assembly engaging portion with the sleeve engaging locking assembly associated with the pill case.
Figure 6:
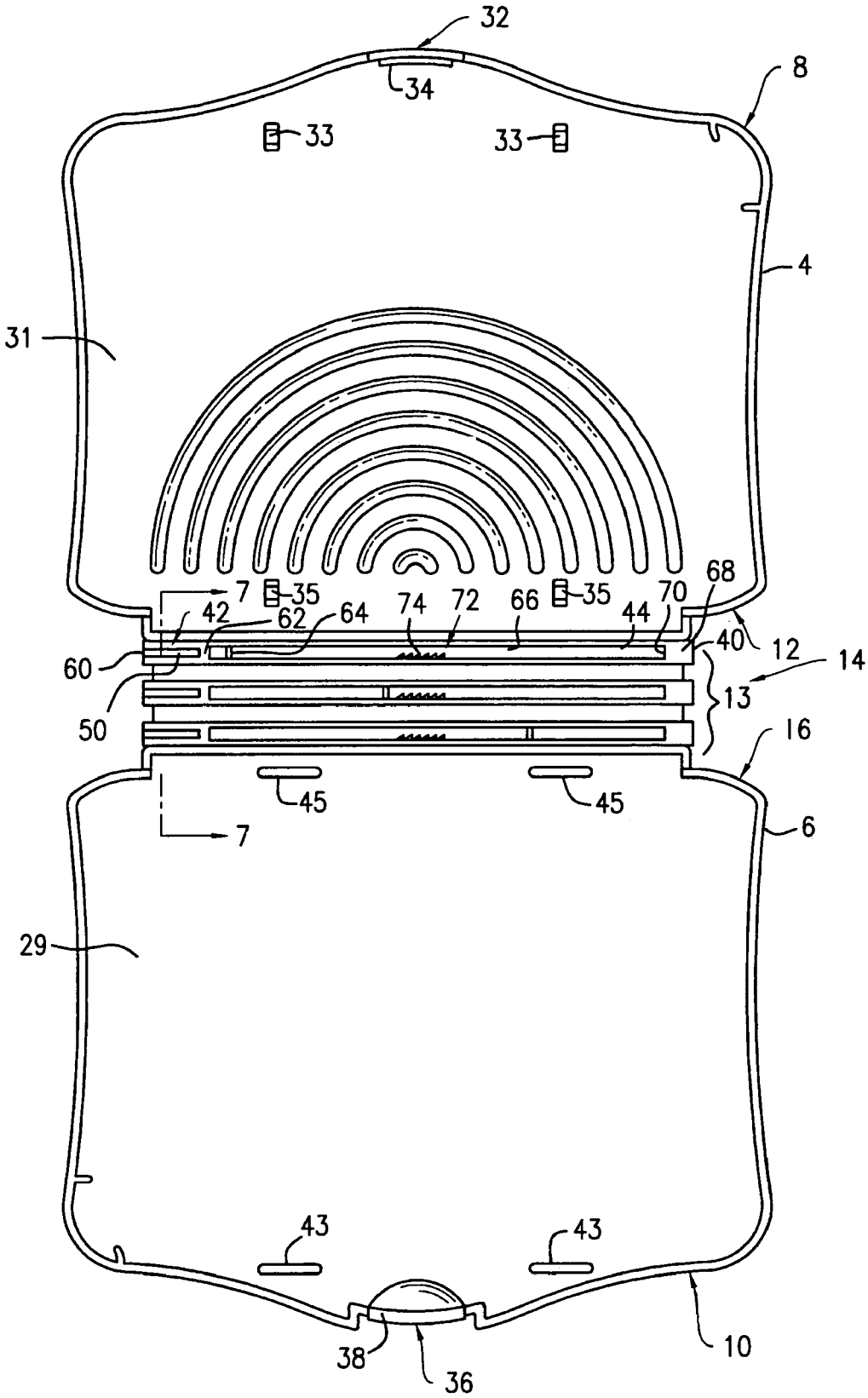
FIG. 6 is a plan view of the embodiment of the pill case shown in FIG. 1 with the top and bottom covers spaced apart from each other and the pill receiving sleeves removed therefrom to show an embodiment of a sleeve engaging locking assembly for removably securing pill receiving sleeves therein.
Figure 7:
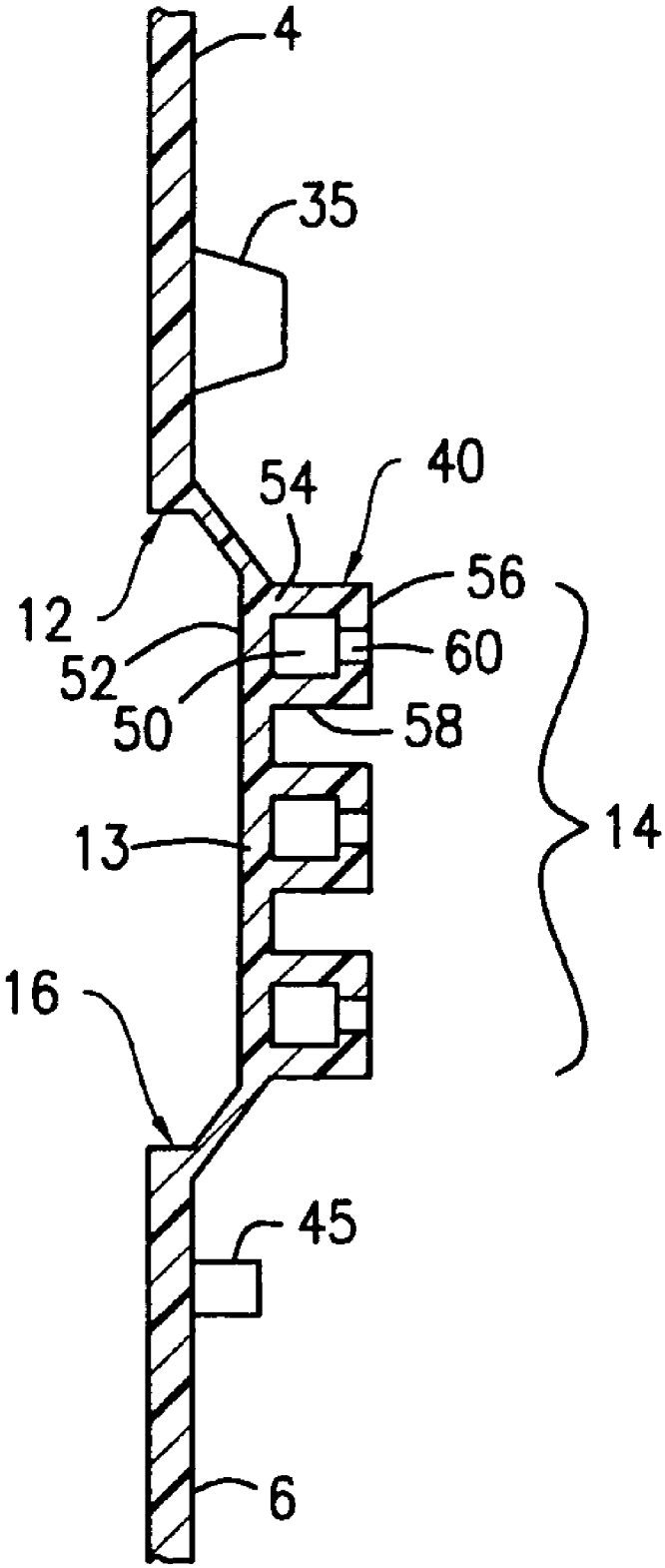
FIG. 7 is a cross-sectional view of a portion of the sleeve engaging locking assembly of the pill case taken along line 7—7 of FIG. 6.

The pill receiving sleeves 18 are individually removably secured to the spine 13 of the pill case 2 through a sleeve engaging locking assembly 14. Referring to FIGS. 5–7, there is shown an embodiment of the sleeve engaging locking assembly 14 in which the pill receiving sleeves 18 are removably secured to the spine 13 through a side loading motion. It will be understood that other methods of removably securing the sleeve 18 to the spine 13 may be employed. The sleeve engaging locking assembly 14 positioned on the spine 13 comprises at least one, typically a plurality of sleeve engaging connector assemblies 40 with each sleeve engaging connecting assembly 40 adapted to receive a single pill receiving sleeve 18.

The sleeve engaging connector assembly 40 is adapted to receive pill receiving sleeves 18 in a side loading motion (i.e. transverse to the direction of a line extending from spine 13 to the respective forward ends 8, 10 of the top cover 4 and the bottom cover 6. The side loading motion, as described in detail hereinafter, enables efficient loading of replacement sleeves for reusable pill cases while securely retaining the sleeves 18 within the pill case 2.

The sleeve engaging connecting assembly 40 comprises a first channel portion 42 and a second channel portion 44, with each channel portion 42, 44, adapted to receive a corresponding projection 46, 48, of a sleeve engaging locking assembly engaging portion 76 of the pill receiving sleeve 18 for operative reversible locking engagement as hereinafter described and as shown best in FIG. 5.

The first channel portion 42 as shown in FIGS. 6 and 7 includes a first channel 50 formed by a base wall 52, opposed side walls 54 and a top wall 56 forming a longitudinally extending opening 60. At one end of the longitudinally extended opening 60 is a bar 62 which extends transverse to the opening 60 and partially downward into the first channel 50 leaving an opening therein for receiving in reversible locking engagement a portion of the sleeve engaging locking assembly engaging portion 76 of the pill receiving sleeve 18 as hereinafter described.

Spaced apart from the downwardly extending bar 62 is a detent 64 which extends upwardly in the first channel 50 and facilitates the reversible locking engagement of the pill receiving sleeve 18 within the first channel portion 42.

The second channel portion 44 is comprised of a second channel 66 which extends from the detent 64 of the first channel 50 to an end portion 68 having an opening 70 therein for receiving in reversible locking engagement, a locking arm portion of a sleeve engaging locking assembly engaging portion as hereinafter described.

The second channel 66 may contain a gripping portion 72 to provide frictional contact with the sleeve engaging locking assembly engaging portion 76 of the pill receiving sleeve 18 to secure the same within the second channel 66. In the embodiment shown specifically in FIG. 6, the gripping portion 72 is in the form of a plurality of spaced apart teeth 74.

Figure 8:
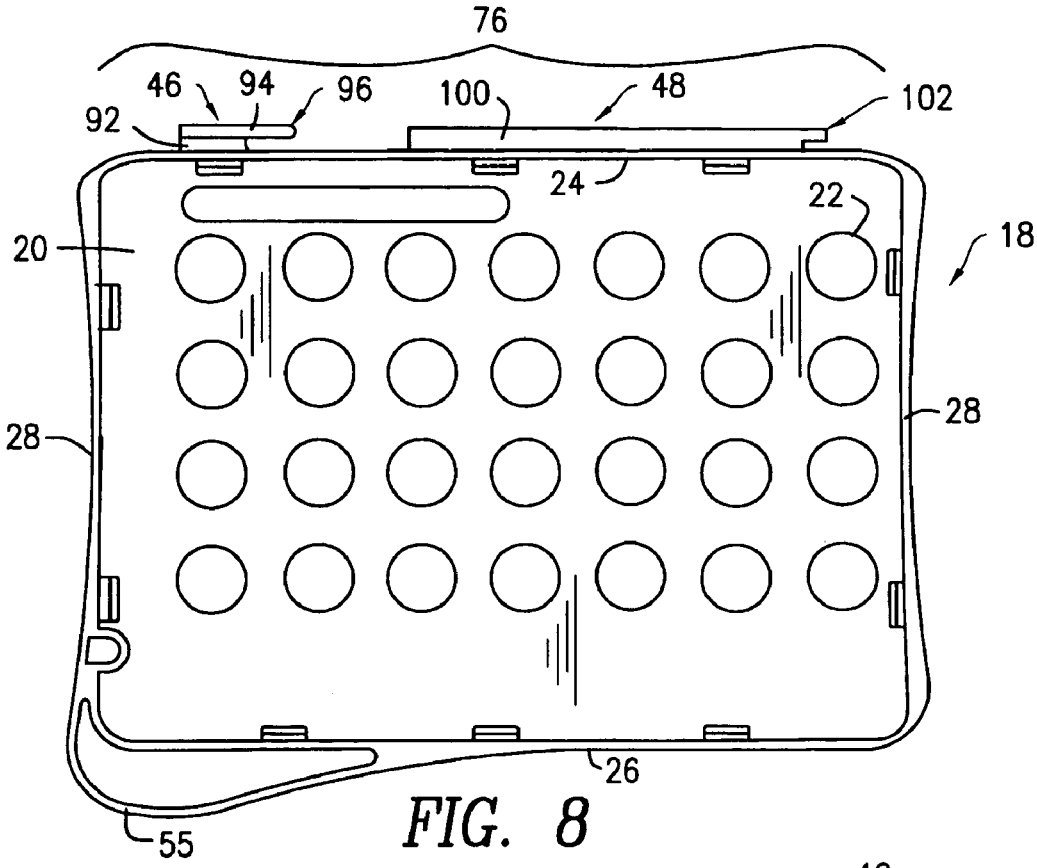
FIG. 8 is a bottom view of a pill receiving sleeve of the present invention employed in the embodiment of the pill case shown in FIG. 1.
Figure 9:
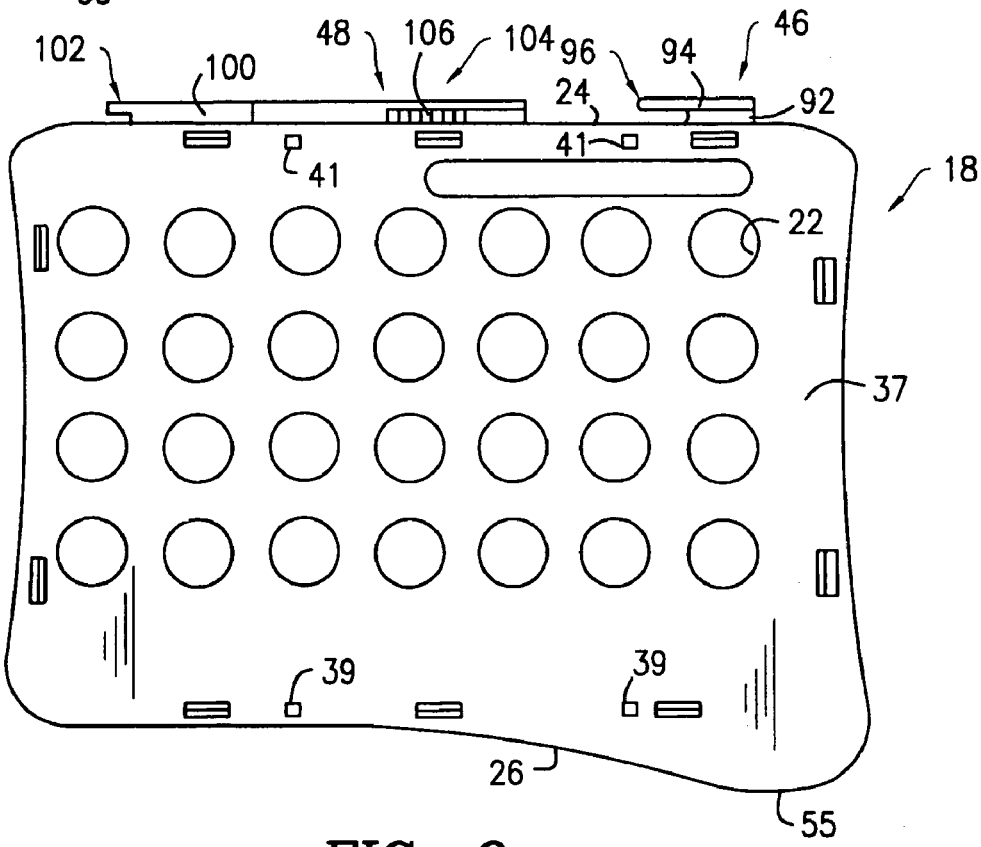
FIG. 9 is a top view of the pill receiving sleeve shown in FIG. 8.

Engagement of the pill receiving sleeve 18 within the sleeve engaging locking assembly 14 is made possible by providing the sleeve engaging locking assembly engagement portion 76 shown best in FIGS. 8 and 9. Referring to FIGS. 8 and 9, the sleeve locking engagement portion 76 of the pill receiving sleeve 18 comprises a first engagement portion 46 and a second engagement portion 48. The first engagement portion 46 is operatively engaged to the rearward wall 24 of the pill receiving sleeve 18 and includes a base 92 having a laterally extending arm 94 including a locking arm portion 96 which is adapted to be inserted into the first channel 50 of the sleeve engaging connecting assembly 40. In the embodiment shown in FIGS. 8 and 9, the locking arm portion 96 is adapted to operatively engage the underside of the bar 62 extending partially downward into the first channel 50 for purposes of locking the first engagement portion 46 within the sleeve engaging locking assembly 14 through a side loading motion.

The second engagement portion 48 is likewise secured to the rearward wall 24 of the pill receiving sleeve 18. The second engagement portion 48 has a longitudinally extending arm 100 with a locking portion 102 in the form of an extension which is adapted to be received within the opening 70 of the end portion 68 in the second channel 66.

As specifically shown in FIG. 9, the second engagement portion 48 may be provided with a gripping portion 104 which may be in the form of a plurality of spaced apart teeth 106 which are adapted to operatively engage the spaced apart teeth 74 of the gripping portion 72 contained within the second channel 66 as previously described.

The engagement and disengagement of the pill receiving sleeve 18 into and out of the sleeve engaging locking assembly 14 via a side loading motion may be described in conjunction with FIGS. 5, 8 and 9. Referring to these figures, the first engagement portion 46 with the locking arm portion 96 advanced is inserted in a side loading motion into the longitudinally extending opening 60 of the first channel portion 42 until the locking arm portion 96 is secured against the underside of the bar 62 with the tip of the first engagement portion 46 resting against the detent 64 contained within the first channel 50.

Simultaneously, the second engagement portion 48 is inserted into the second channel portion 44 and moved to the right in a side loading motion so that the locking portion secures within the opening 70 at the far end of the second channel 66. Accidental movement of the pill receiving sleeve 18 from the sleeve engaging locking assembly 14 is prevented by the operative engagement of the respective gripping portions 72 and 104 contained within the second channel portion 44 and on the second engagement portion 48.

The pill receiving sleeve 18 may be removed from operative engagement with the sleeve engaging locking assembly 14 by exerting a force in the opposite direction (i.e. to the left) from that required to obtain operative engagement. This necessitates as shown in FIG. 5 a side unloading motion with the pill receiving sleeve 18 being slid to the left until the first and second engagement portions 46 and 48 disengage from the first and second channel portions 42, 44 respectively. It will be understood that the configuration of the sleeve engaging locking assembly may be such that the side loading direction may be different so long as the pill receiving sleeve can be operatively engaged and disengaged to the spine.

Figure 11:
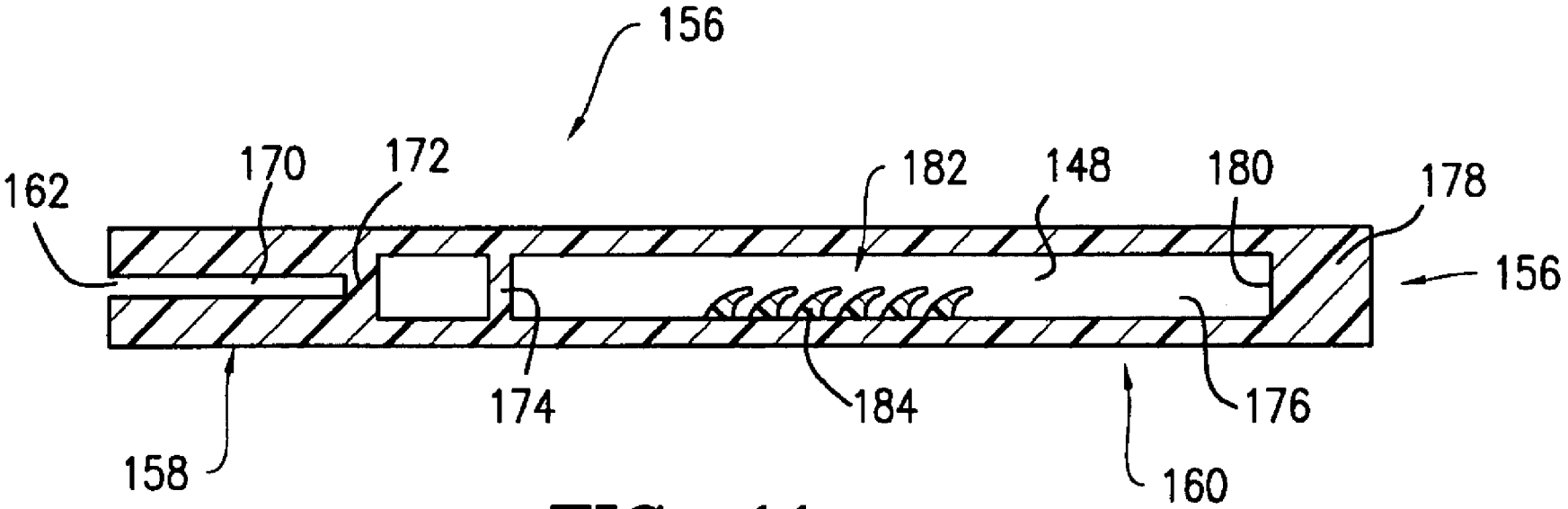
FIG. 11 is a plan view of the sleeve engaging locking assembly shown in FIG. 10.
Figure 12:
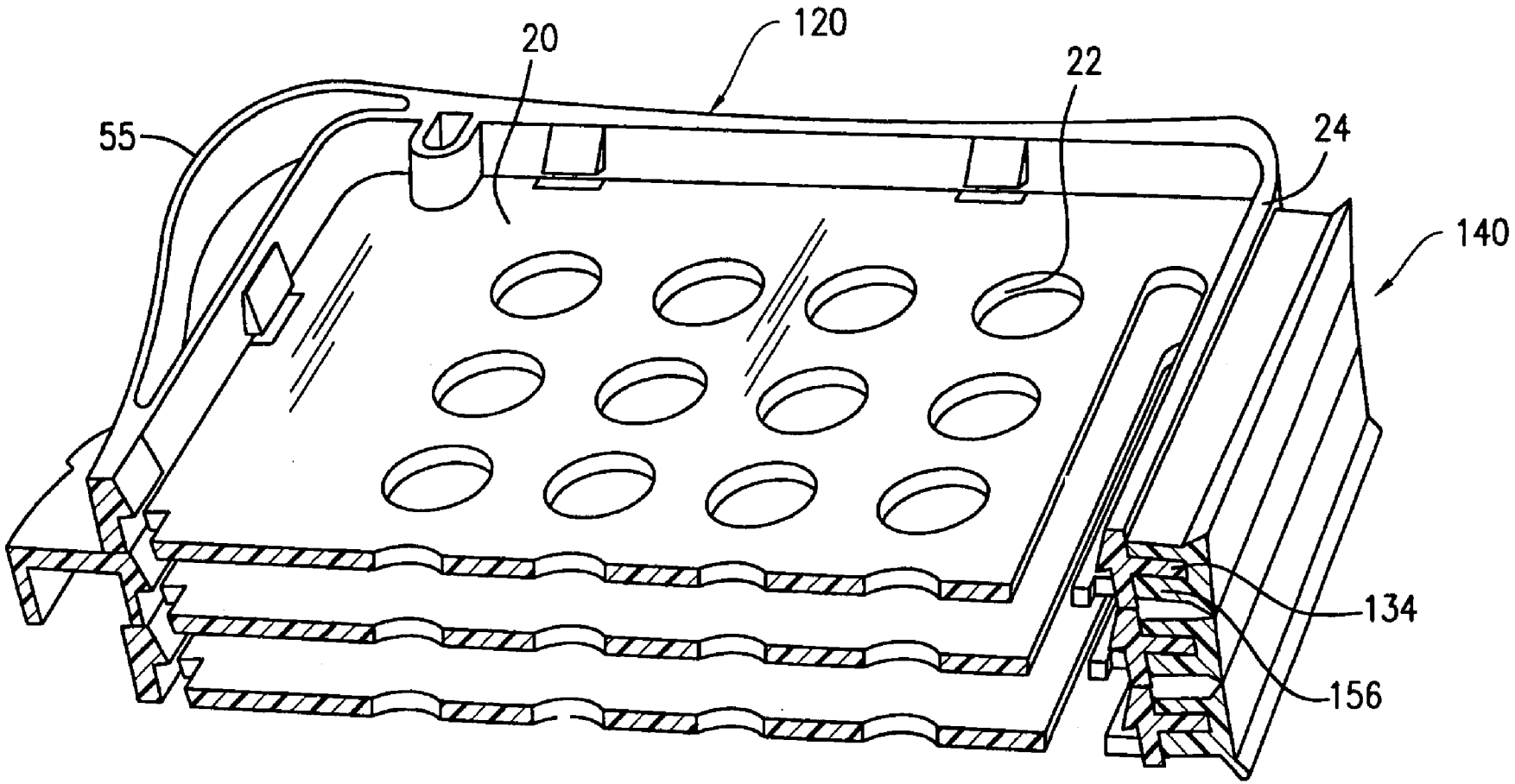
FIG. 12 is a cross-sectional of the sleeve engaging locking assembly taken along a line 12—12 of FIG. 10.

In a further embodiment of the invention, the pill receiving sleeves 18 as previously described as well as the top and bottom covers may be secured in operative relationship to each other by another type of sleeve engaging locking assembly as shown in FIGS. 10–12. The embodiment shown therein may be used to removably secure the individual pill receiving sleeves but may also be used to permanently secure the pill receiving sleeves in operative engagement so that the pill case may be used as a disposable (e.g. when all the pills are consumed, the pill case is discarded).

Referring specifically to FIGS. 10–12, there is shown a pill case 102 in which the pill receiving sleeves 120 are each provided with a sleeve engaging locking assembly engagement portion 122 comprising a first engagement portion 124 and a second engagement portion 126. The first engagement portion 124 is operatively engaged to the rearward wall 24 of the pill receiving sleeve 120 and includes a base 128 having a laterally extending arm 130 which extends beyond the length of the base 128.

The second engagement portion 126 is likewise secured to the rearward wall 24 of the pill receiving sleeve 120. The second engagement portion 126 has a longitudinally extending arm 132 preferably including a centrally positioned gripping mechanism in the form of teeth 134.

There is also provided a sleeve engaging locking assembly 140 which is adapted to engage the sleeve locking engagement portions 122 of the pill receiving sleeves 120 via a side loading motion to secure the same together. As shown in FIGS. 10 and 12, the sleeve engaging locking assembly 140 comprises a structural arrangement which is complimentary to the sleeve locking engagement portions 122 so that when operatively engaged to each other the pill receiving sleeves 120 are held in operative spaced apart arrangement to form the pill carrying portion of the pill case 102.

As shown in FIG. 11, the sleeve engaging connecting assembly 156 comprises a first channel portion 158 and a second channel portion 160, with each channel portion 158,160, adapted to receive a corresponding projection from the pill receiving sleeve for operative reversible locking engagement as hereinafter described.

The first channel portion 158 includes a first channel 162 with a longitudinally extending opening 170. At one end of the longitudinally extended opening 170 is a bar 172 which extends transverse to the opening 170 and partially downward into the first channel 162 leaving an opening therein for receiving in reversible locking engagement, a portion of a sleeve engaging locking assembly engaging portion of the pill receiving sleeve 18.

Spaced apart from the downwardly extending bar 172 is a detent 174 which essentially separates the first channel portion 158 from the second channel portion 160.

The second channel portion 160 is comprised of a second channel 176 which extends from the detent 174 of the first channel 162 to an end portion 178 having an opening 180 therein for reversible locking engagement of a locking arm portion of a sleeve engaging locking assembly engaging portion as hereinafter described.

The second channel 176 may contain a gripping portion 182 to provide frictional contact with the sleeve engaging locking assembly engaging portion of the pill receiving sleeve 18 to engage the same within the second channel 176. The gripping portion 182 is in the form of a plurality of spaced apart teeth 184.

Engagement of the pill receiving sleeve 18 within the sleeve engaging locking assembly 140 is made possible by providing the sleeve engaging locking assembly engagement portion 122 discussed above and shown best in FIGS. 10 and 11 comprised of the first engagement portion 124 and the second engagement portion 126. The first engagement portion 124 is adapted to be inserted into the first channel 162 of the sleeve engaging connecting assembly 158 and secured beneath the bar 172 within the first channel portion 158. The second engagement portion 126 is adapted to be received within the opening 180 of the end portion 178 in the second channel 176.

The gripping portion of the second engagement portion 126 which may be in the form of a plurality of spaced apart teeth 134 is adapted to operatively engage the spaced apart teeth 184 of the gripping portion 182 contained within the second channel 176.

Figure 13:
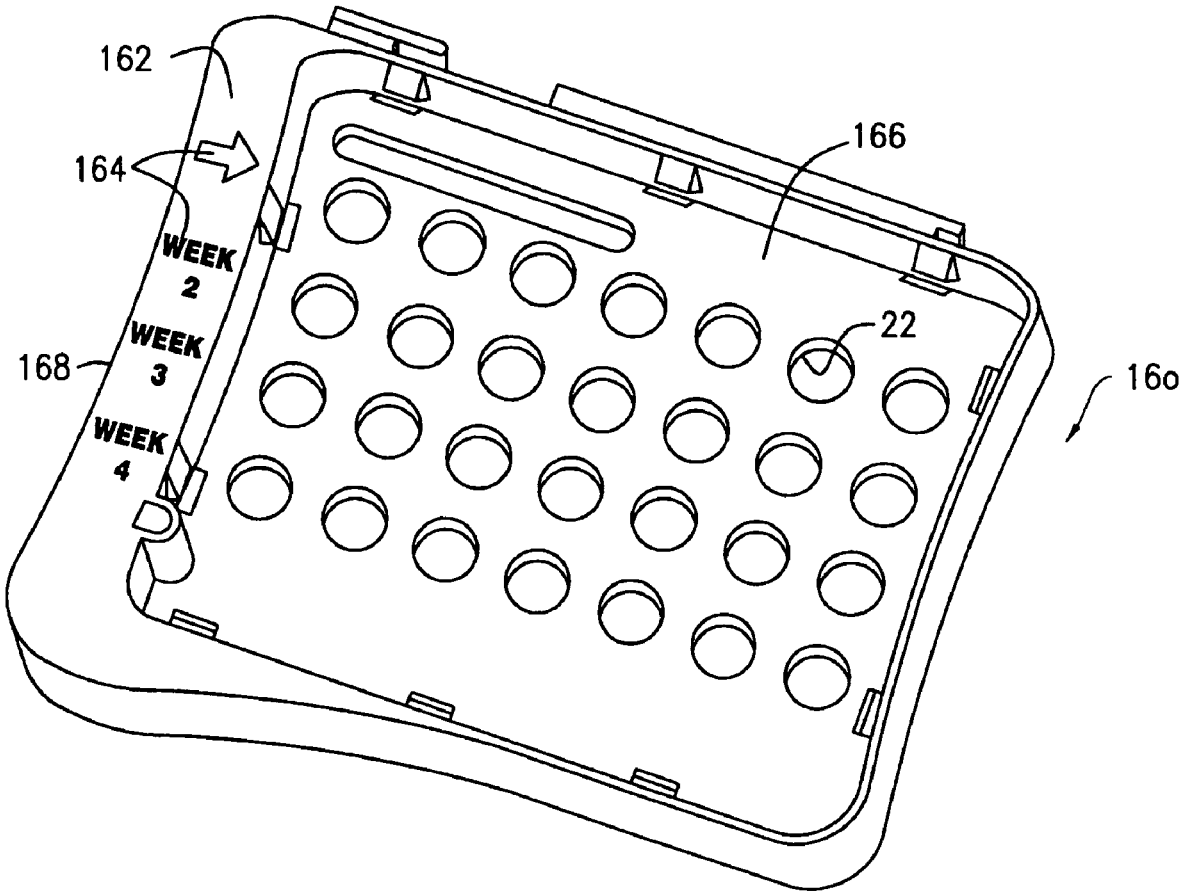
FIG. 13 is a top perspective view of yet another embodiment of a pill receiving sleeve of the present invention.

With reference to FIG. 13, a pill receiving sleeve 160 is shown for an alternate embodiment. The pill receiving sleeve 160 includes the corresponding similar features as described in FIGS. 8 and 9. The pill receiving sleeve 160 further includes a pill containing area 166, a surface portion 162 of a sidewall 168, and indicia 164 located on the surface portion 162 which may instruct the user as to the dosage regimen in which the corresponding medication is to be dispensed. In this example, the indicia 164 designate to the user the weekly pill groupings to be retained in the pill containing area 30. Each pill contained in the pill containing area 166 is dispensed via a corresponding aperture 22 on a daily basis. The indicia 164 inform the user as to the specific pill grouping that is to be dispensed for a particular week. It will be understood that the indicia can provide additional alternative information that may be useful including the name of the drug and the like.

Further embodiments of the present invention would be apparent to those of ordinary skill in the art and are included within the spirit and scope of the present invention. For example, the present pill case may be adapted to house an extended dosage regimen of an oral contraceptive. This regimen may consist of 12 consecutive weeks/84 days of pills containing active ingredients, followed by one week of placebos. Thus, the third sleeve of the pill case may be provided with five rows of seven apertures while the first two sleeves are provided with four rows of seven apertures. An example of such a dosage regimen is used in oral contraceptives marketed by Barr Laboratories under the trademark Seasonale®.

This oral contraceptive (levonorgestrel/ethinyt estradiol tablets) is an extended-cycle oral contraceptive consisting of 84 pink active tablets each containing 0.15 mg of levonorgestrel, a synthetic progestogen and 0.03 mg of ethinyl estradiol, and 7 white inert tablets (without hormones). The chemical formula of levonorgestrel USP is 18, 19-Dinor-pregn-4-en-20-yn-3-one, 13-ethyl-17-hydroxy-, (17*a*)-, (−)-, and the chemical formula of ethinyl estradiol USP is 19-Nor-pregna-1,3,5(10)-trien-20-yne-3, 17-diol, (17*a*).

Each pink active tablet contains the foflowing inactive ingredients: anhydrous lactose NF, FD&C blue no. 1, FD&C red no. 40, hydroxypropyl methylcellulose USP, microcrystalline cellulose NF, polyethylene glycol NF, magnesium stearate NF, polysorbate 80 NF, and titanium dioxide USP. Each white inert tablet contains the following inactive ingredients: anhydrous lactose NF, hydroxypropyl methylcellulose USP, microcrystalline cellulose NF, and magnesium stearate NF.

What is claimed is:

1. A case for receiving and dispensing pills, comprising:

at least one sleeve containing a plurality of pills secured within the sleeve and adapted to be dispensed therefrom, the sleeve having a rearward edge for engaging a spine and a plurality of apertures, each aperture for receiving one of the plurality of pills in a position so that each pill of the plurality of pills may be dispensed from one of the plurality of apertures; and a spine comprising a sleeve engaging locking assembly operatively engaging the at least one sleeve at the rearward edge so that the at least one sleeve is secured to the spine and can be accessed to dispense the pills contained therein;

wherein the sleeve engaging locking assembly comprises at least one channel, and the at least one sleeve comprises at least one spine engaging projection adapted to be slidably secured within the at least one channel to secure the at least one sleeve within the case.

2. The case of claim 1 wherein the case comprises a plurality of sleeves and the spine comprises a plurality of channels, each sleeve of said plurality of sleeves having the spine engaging projection slidably received within one of the corresponding plurality of channels of the spine to attach each sleeve of the plurality of sleeves to the spine.

3. The case of claim 2 wherein the case comprises three sleeves and the sleeve engaging locking assembly of the spine comprises at least one sleeve receiving channel for each of the three sleeves.

4. The case of claim 1, comprising a blister card containing the plurality of pills, each of the pills within the blister card being aligned with a corresponding aperture of the plurality of apertures of the at least one sleeve so that the pills may be dispensed from the blister card through the corresponding apertures.

5. The case of claim 3 wherein the three sleeves are engaged to the spine in a stacked arrangement.

6. The case of claim 1 wherein the at least one channel of the sleeve engaging locking assembly of the spine comprises projection engaging means for securing the spine engaging projection of the at least one sleeve within the at least one channel.

7. The case of claim 6 wherein the sleeve engaging locking assembly comprises first and second channels and the at least one sleeve comprises first and second projections, wherein the first projection is secured within the first channel and the second projection is secured within the second channel.

8. The case of claim 1 further comprising a top cover and a bottom cover operatively engaged to the spine with the at least one sleeve positioned between the top cover and the bottom cover.

9. The case of claim 5 further comprising first securing means for the securing the three sleeves in a stacked arrangement.

10. The case of claim 9 wherein the first securing means comprises means for securing the three sleeves together so that only one of the three sleeves is exposed for dispensing pills.

11. The case of claim 10 wherein the first securing means comprises a pair of detents on an underside of one of the three sleeves for frictionally engaging an adjacent one of the three sleeves.

12. A case for receiving and dispensing pills, comprising:

a top cover having a forward edge and a rearward edge;

a bottom cover having a forward edge and a rearward edge;

a spine extending between the top cover and the bottom cover, to which the top cover and the bottom cover are affixed at the rearward edges thereof;

at least one sleeve containing a plurality of pills secured within the sleeve and adapted to be dispensed therefrom, the sleeve having a forward edge and a rearward edge and being attached to the spine at the rearward edge thereof between the top cover and the bottom cover, and a plurality of apertures, each aperture for receiving one of the plurality of pills in a position so that each pill of the plurality of pills may be dispensed from one of the plurality of apertures;

wherein the plurality of pills contained in the at least one sleeve are further contained in a blister card received within the at least one sleeve, each of the pills within the blister card being aligned with a corresponding aperture of the at least one sleeve so that the pills may be dispensed from the blister card through the corresponding apertures.

13. The case of claim 12 wherein the spine comprises a sleeve engaging locking assembly operatively engaging the rearward edge of the at least one sleeve and the at least one sleeve comprising a spine engaging projection for securing the at least one sleeve to the spine through the sleeve engaging locking assembly.

14. The case of claim 13 wherein the sleeve engaging locking assembly comprises at least one channel wherein the spine engaging projection is adapted to be slidably secured within the at least one channel.

15. The case of claim 14 wherein the sleeve engaging locking assembly comprises a pair of channels for receiving a corresponding pair of spine engaging projections on the at least one sleeve.

16. The case of claim 13 wherein the case comprises at least three sleeves which are slidably received within the sleeve engaging locking assembly of the spine.

17. The case of claim 16 wherein each one of the at least three sleeves receives a blister card of pills.

18. The case of claim 16 wherein each one of the at least three sleeves is attached to the spine in a stacked arrangement.

19. The case of claim 13 comprising at least three sleeves attached to the spine by the sleeve engaging locking assembly.

20. The case of claim 19 wherein the sleeve engaging locking assembly comprises at least one channel.

21. The case of claim 16 wherein at least one of the at least three sleeves is provided with more apertures than the remaining of the sleeves.

22. The case of claim 21 wherein two of the sleeves comprise 28 apertures and a third sleeve comprises 35 apertures.

23. The case of claim 16 further comprising first securing means for securing the at least three sleeves in a stacked arrangement.

24. The case of claim 23 wherein the first securing means secures the at least three sleeves together so that only one of the at least three sleeves is exposed for dispensing pills.

25. The case of claim 24 wherein the first securing means comprises a pair of detents on an underside of one of the at least three sleeves for frictionally engaging an adjacent sleeve.

26. The case of claim 12 further comprising second securing means for securing at least one of the top cover and bottom cover to an adjacent at least one sleeve.

27. The case of claim 26 wherein the second securing means comprises at least one pair of detents affixed to at least one of the top cover and bottom cover for frictionally engaging the adjacent at least one sleeve.

28. A case comprising:

a) at least one pill receiving sleeve comprising a pill storage portion for storing a plurality of pills therein and a sleeve engaging locking assembly engaging portion;

b) a top cover and a bottom cover each having a first side for operatively engaging a sleeve engaging locking assembly and an opposed side, the top and bottom covers being movable toward each other to place the case in a closed position wherein the pills within the at least one pill receiving sleeve are not exposed, and away from each other to an open position wherein the at least one pill receiving sleeve and the pills received therein are exposed; and c) a sleeve engaging locking assembly operatively engaged to the first side of each of the top cover and the bottom cover and comprising at least one sleeve engaging connector for engaging the sleeve engaging locking assembly engaging portion of the at least one pill receiving sleeve in a side loading motion.

29. A case for receiving at least three blister cards of pills, said case comprising a spine and at least three sleeves, each one of said at least three sleeves configured to receive one of said at least three blister cards of pills, each of said at least three sleeves being commonly attached to said spine.

30. The case of claim 1 wherein at least some of the plurality of pills contain an oral contraceptive fonnula.

31. The case of claim 3 wherein the plurality of pills comprise eighty-four pills each containing an effective amount of levonorgestrel and an effective amount of ethinyl estradiol, and seven inert pills.

32. The case of claim 12 wherein at least some of the plurality of pills contain an oral contraceptive formula.

33. The case of claim 16 wherein the plurality of pills comprise eighty-four pills each containing an effective amount of levonorgestrel and an effective amount of ethinyl estradiol, and seven inert pills.

34. The case of claim 28 wherein at least some of the plurality of pills contain an oral contraceptive formula.

35. The case of claim 34 wherein the case comprises three pill receiving sleeves and the plurality of pills comprises eighty-four pills each containing an effective amount of levonorgestrel and an effective amount of ethinyl estradiol, and seven inert pills.

36. The case of claim 29 wherein at least some of the pills contain an oral contraceptive formula.

37. The case of claim 36 wherein the oral contraceptive formula comprises an effective amount of levonorgestrel and an effective amount of ethinyl estradiol.

38. The case of claim 28 wherein the sleeve engaging locking assembly portion is a projection and the sleeve engaging connector is a channel that receives the projection.

39. The case of claim 29 wherein the sleeves are attached to the spine by a sleeve engaging locking assembly comprising at least one projection and at least one channel.

* * * * *